US005588168A

United States Patent [19]

Byrne et al.

[11] Patent Number: 5,588,168

[45] Date of Patent: Dec. 31, 1996

[54] CONTOURED SYMMETRICAL DIFFERENTIAL-ELASTICITY NECK PILLOW

[76] Inventors: Thomas Byrne, 10055 S. Maplewood, Chicago, Ill. 60655; John O'Connor, 10504 S. Claremont, Chicago, Ill. 60643

[21] Appl. No.: 599,482

[22] Filed: Jan. 23, 1996

[51] Int. Cl.[6] ..... A47G 9/00

[52] U.S. Cl. ..... 5/636; D6/601

[58] Field of Search ..... 5/636–645, 481, 5/653, 654, 464, 901; D6/601

[56] References Cited

U.S. PATENT DOCUMENTS

| | | | |
|---|---|---|---|
| D. 322,380 | 12/1991 | El-Asir | D6/601 |
| D. 328,682 | 8/1992 | Carney | D6/601 |
| 1,742,186 | 1/1930 | Claus | 5/653 |
| 3,064,279 | 11/1962 | Finkle | 5/636 |
| 3,141,179 | 7/1964 | McLean | 5/636 |
| 3,521,310 | 7/1970 | Greenwalt | 5/636 |
| 3,848,281 | 11/1974 | Mathews | 5/636 |
| 4,726,087 | 2/1988 | Schaefer et al. | 5/636 |
| 4,768,246 | 9/1988 | Summer | 5/636 |
| 4,996,734 | 3/1991 | Rowe | 5/636 |
| 5,123,132 | 6/1992 | Dixon | 5/636 |
| 5,205,611 | 4/1993 | Stephens | 5/636 |

*Primary Examiner*—Alexander Grosz
*Attorney, Agent, or Firm*—Niro, Scavone, Haller & Niro

[57] ABSTRACT

This invention relates to a contoured neck pillow. The invention consists of a central pad of polyurethane foam having a compression of about seven pounds, which is relatively softer and more elastic than a surrounding ring of polyurethane foam having a compression of about fifteen to twenty pounds. Two convoluted foam sections enclose the ring and pad, and are in turn encased within a protective cover.

4 Claims, 1 Drawing Sheet

CONTOURED SYMMETRICAL DIFFERENTIAL-ELASTICITY NECK PILLOW

BACKGROUND OF THE INVENTION

1. Field of the Invention

This invention is an improved contoured pillow for supporting a person's head and neck. The invention has structure which has differential elasticity, that is, it includes two regions of different softness or resistance to provide comfortable support. It can be rotated and inverted, and therefore has greater durability and ease of use.

2. Description of the Prior Art

Neck pillows typically have shapes which inhibit use of the pillow if it is inverted or rotated or both. Some pillows have rectangular or irregular shapes, requiring the pillow to be placed in a specific orientation with respect to the user's head and neck before the pillow can effectively be used. Others have shapes, protrusions or extensions which reduce the comfort and usefulness of the pillow if it is inverted. U.S. Pat. No. 4,996,734, "T-Shaped Pillow With Neck Supporting Portion," to Shelba Rowe is one such example. Another is U.S. Pat. No. 5,205,611, "Head Support Pillow," to Frederick Stephens. Others have central openings that may affect the user's comfort depending on the position of the user's head and neck with respect to the pillow. See, for example, U.S. Pat. No. Des. 322, 380, "Inflatable Neck Pillow," to Rabel El-Asir.

BRIEF SUMMARY OF THE INVENTION

We have found that a more comfortable and useful pillow can be made by designing the pillow to be symmetrical in two dimensions and to employ two materials of differing characteristics. In a preferred embodiment of the invention, the pillow is circular and has no tabs or protrusions. A central portion of the pillow is also circular and is made of a material with a different resistance than the remaining part of the pillow. The pillow supports the neck in a gentle curve, and supports the head, too. As a result, the pillow can be used by a person resting on his or her side, or back. The pillow performs its function even if the user shifts his or her position, or changes the position of the pillow. Thus, the pillow is symmetrical both with respect to rotation and inversion. As a result of its design, the pillow has greater durability and wear resistance, too.

The pillow also employs regions of different elasticity or softness, in order to provide firmer support anywhere around the outer portion of the pillow, and softer support in the central portion of the pillow. This differential elasticity is preserved even if the pillow is rotated or turned over.

It is an object of the invention, therefore, to provide a support to both the user's head and neck which keeps the neck in a gently curved position, rather than straight.

It is a further object of the invention to provide a pillow that has portions of different elasticity to support the user's head and neck.

It is a further object of the invention to provide a structure which preserves the supporting ability of the pillow even if the pillow is rotated, inverted, or both.

It is a further object of the invention to provide a structure that results in increased durability and wear resistance.

DETAILED DESCRIPTION OF THE DRAWINGS

Figure 1:
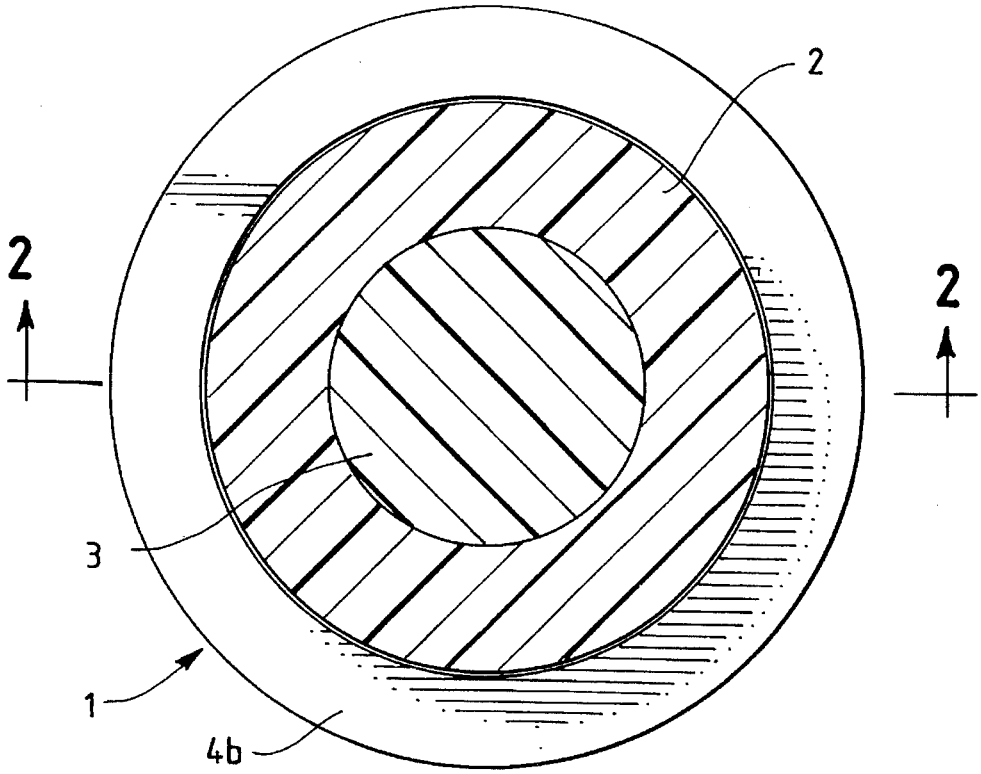
FIG. 1 is a cross-sectional view of a contoured neck pillow made according to the invention, taken along the section shown in FIG. 2.
Figure 2:
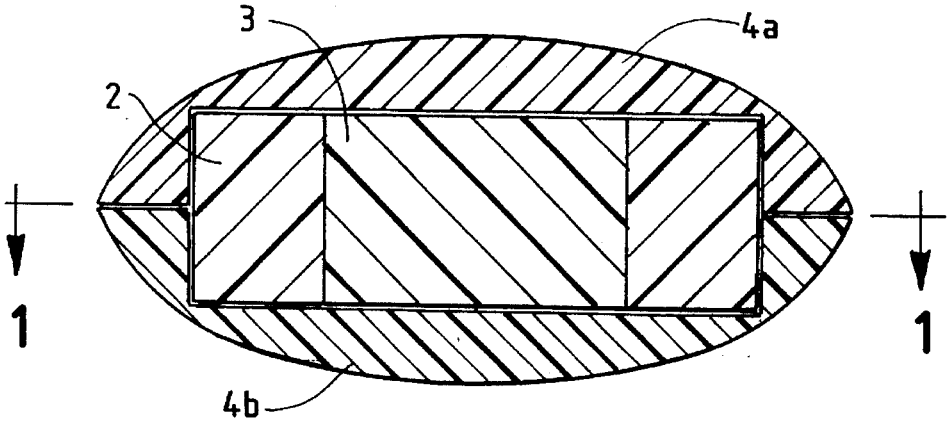
FIG. 2 is a cross-sectional view of the invention on the section shown in FIG. 1.

Referring to both figures, the invention 1 consists of an annular ring 2 with a central pad 3, made of a different material. The entire pillow is enclosed in a case, which is not shown.

Annular ring 2 consists of polyurethane foam with a density of 0.9 pounds per cubic foot and a compression in the range of fifteen to twenty pounds. A widely used test for compression is standard D3574-77 of the American National Standards Institute and American Society for Testing of Materials (ANSI/ASTM). Compression means the amount of force required to depress a plate of a given size downward through a specified percentage of the thickness of a piece of foam. It is also called the Indentation Force Deflection (IFD). Thus, the IFD or compression for ring 2 is in the range of approximately fifteen to twenty pounds.

In the preferred embodiment, annular ring 2 has a diameter of sixteen inches, and a thickness of two and one-half inches. These dimensions are selected based upon the average dimensions of a person's head, approximately eight inches along the long axis of the body, and a person's neck, about four inches in the same direction. Representative dimensions are available in journals; see for example *The Journal of Forensic Sciences*, Vol. 40, No. 1, January 1995, pages 59–62, or Spine, Vol. 16, No. 8, August 1991, pages 861–69. The average person's head weighs about sixteen pounds, and ranges between fifteen and twenty pounds.

Annular ring 2 has a central opening which, in the preferred embodiment, is eight inches in diameter. The central opening is filled with central pad 3. In the preferred embodiment, central pad 3 is made of polyurethane foam with a density of 0.55 pounds per cubic foot. Experience has shown that this foam is more durable, has superior loft retention (thus maintaining its body), and minimal loss of compression as compared to polyester fiber. For the foam used in central pad 3, the compression or IFD is approximately seven pounds to achieve 25 percent compression of the foam.

Central pad 3 is cut to the eight-inch diameter of the central opening in annular ring 2, thus offering a different resistance to the user than does annular ring 2.

Once central pad 3 is installed in annular ring 2, the entire structure is placed between convoluted clamshell-shaped foam sections **4*a* and 4*b*, which are attached to the remaining structure by any convenient means, for example, adhesive. Thus, central pad 3 need not be glued to ring 2 because both are covered by sections 4*a* and 4*b*. Sections 4*a* and 4*b* have the same density and compression as does ring 2. The convolutions in sections 4*a* and 4*b* increase the pillow's conformance to the head and neck of the user, support and align the spine, and reduce pressure points on the joints and muscles of the body, contributing to restful sleep. Once foam sections 4*a* and 4*b* have been attached, the entire pillow 1** is placed inside a protective cover, not shown.

In use, therefore, the pillow can be rotated through 360°, allowing a user to shift to another section of the pillow. This increases the durability of the pillow by avoiding wear spots.

It also enhances the usability of the pillow; since the head and neck are not in the same location all of the time, the tendency to form dead spots or depressions is reduced.

Pillow 1 can also be inverted and can still be used, another advantage when compared to older pillows.

Finally, the central pad 3, being softer, provides a comfortable support for the user's head. At the same time, the relatively stiffer and less elastic annular ring 2 supports the user's neck, tending to keep the neck slightly curved.

We claim:

1. A contoured neck pillow comprising:

a round central pad comprised of resilient foam having a compression of approximately seven pounds and a diameter of approximately eight inches;

an annular ring comprised of resilient foam having a compression of from fifteen to twenty pounds, and having an outer diameter of approximately sixteen inches; and two foam sections enclosing the central pad and annular ring, and permanently attached thereto; whereby the pillow provides differential elasticity that is not altered by inverting or rotating the pillow.

2. The contoured neck pillow of claim 1, wherein the resilient foam comprises polyurethane foam.

3. The contoured neck pillow of claim 1, wherein the two foam sections are convoluted.

4. The contoured neck pillow of claim 1, further comprising a protective cover.

* * * * *